US011358753B2

(12) United States Patent
McAtarian et al.

(10) Patent No.: US 11,358,753 B2
(45) **Date of Patent: *Jun. 14, 2022**

(54) EQUIPMENT TRANSFER BAG

(71) Applicant: Andax Industries LLC, St. Mary's, KS (US)

(72) Inventors: Patrick F. McAtarian, St. Mary's, KS (US); Mark McAtarian, St. Mary's, KS (US)

(73) Assignee: Andax Industries LLC, St. Marys, KS (US)

( * ) Notice: Subject to any disclaimer, the term of this patent is extended or adjusted under 35 U.S.C. 154(b) by 466 days.

This patent is subject to a terminal disclaimer.

(21) Appl. No.: 16/523,084

(22) Filed: Jul. 26, 2019

(65) Prior Publication Data

US 2021/0024254 A1 Jan. 28, 2021

(51) Int. Cl.

| | |
|---|---|
| ***B65D 33/14*** | (2006.01) |
| ***B65D 85/86*** | (2006.01) |
| ***B65D 33/02*** | (2006.01) |
| ***B65D 30/08*** | (2006.01) |
| ***B65D 81/26*** | (2006.01) |

(Continued)

(52) U.S. Cl.

CPC ..... *B65D 33/02* (2013.01); *B65D 29/02* (2013.01); *B65D 33/14* (2013.01); *B65D 81/02* (2013.01); *B65D 81/264* (2013.01); *B65D 85/00* (2013.01); *B65D 2585/86* (2013.01)

(58) Field of Classification Search

CPC ..... B65D 33/14; B65D 33/065; B65D 33/08; B65D 81/264; B65D 85/30; B65D 85/68; B65D 2585/86; B65D 71/22; B65D 88/1675

USPC ..... 383/6, 9, 7, 10; 220/752, 770, 772; 150/901, 154–168

See application file for complete search history.

(56) References Cited

U.S. PATENT DOCUMENTS

| | | | |
|---|---|---|---|
| 2,426,475 | A | 8/1947 | Van Frank |
| 3,060,987 | A | 10/1962 | Adams |
| 3,870,358 | A | 3/1975 | Bennett |

(Continued)

FOREIGN PATENT DOCUMENTS

| | | | |
|---|---|---|---|
| CN | 206691639 | U | 12/2017 |
| DE | 10114892 | C1 | 10/2002 |

(Continued)

OTHER PUBLICATIONS

"Big Orange Bag" Single-Use Pole Mount Transformer Bags product description—see www.abgbag.com.

(Continued)

*Primary Examiner* — Jes F Pascua
*Assistant Examiner* — Nina K Attel
(74) *Attorney, Agent, or Firm* — Hovey Williams LLP

(57) ABSTRACT

An equipment containment and transport assembly (20) includes an open-top equipment-receiving primary bag (22) having upstanding sidewall structure (26) equipped with lifting lug opening pairs (30, 32), and a bottom wall (28). The assembly (20) further has a flexible sleeve (24), which is secured to the sidewall structure (26) and is shiftable between a ready position surrounding the sidewall structure (26) and a deployed position extending upwardly for closure or the assembly (20). When deployed, the sleeve (24) covers the lug opening pairs (30, 32). The assembly (20) is particularly useful for containment and shipping of electrical transformers.

32 Claims, 6 Drawing Sheets

(51) Int. Cl.
*B65D 85/00* (2006.01)
*B65D 81/02* (2006.01)

(56) References Cited

U.S. PATENT DOCUMENTS

| | | | |
|---|---|---|---|
| 4,390,051 | A | 6/1983 | Cuthbertson |
| 4,468,933 | A | 9/1984 | Christopher |
| 5,192,134 | A | 3/1993 | Polett |
| 5,251,460 | A | 10/1993 | DeMarco et al. |
| 5,344,109 | A | 9/1994 | Hokoana, Jr. |
| 5,524,949 | A | 6/1996 | Mooney |
| 5,667,266 | A | 9/1997 | Giocanti |
| 6,027,249 | A | 2/2000 | Bielinski |
| 6,494,341 | B2 | 12/2002 | Perkins et al. |
| 6,499,781 | B1 | 12/2002 | Flynn |
| 8,011,500 | B2 | 9/2011 | Lee |
| 8,777,001 | B1 | 7/2014 | Bennett |
| 9,578,937 | B2 | 2/2017 | Kern et al. |
| 2014/0177980 | A1 | 6/2014 | Diao |

FOREIGN PATENT DOCUMENTS

| | | | |
|---|---|---|---|
| EP | 2039620 | B1 | 9/2010 |
| GB | 2076780 | A | 12/1981 |
| RU | 2132296 | C1 | 6/1999 |

OTHER PUBLICATIONS

"Atra HD Transformer Sac" product description—found online at https://linestar.ca/specialty-items/transformer-containment/pad-pole-mount/xtra-hd-transformer-sac/.

20
22
24
26
27
28
30
32
34
36
38
40
41
42

EQUIPMENT TRANSFER BAG

BACKGROUND OF THE INVENTION

Field of the Invention

The present invention is concerned with equipment containment bag assemblies designed to provide environmentally safe shipping and storage conditions for leaking or otherwise non-performing equipment, such as pole-mounted distribution transformers, switchgear, breakers, and reclosers. More particularly, the invention is concerned with such bag assemblies, and methods of use thereof, wherein the assemblies include primary, open-top, equipment-receiving bags with access openings for the equipment lifting lugs, and with associated tubular sleeves designed for closure to effectively envelope the equipment in an environmentally friendly package, while nevertheless permitting lifting of the equipment using the lifting lugs thereof.

Description of the Prior Art

Conventional electrical transformers used in power distribution systems include a sealed, oil-filled tank with internal electrical components, such as transformer coils. These transformers also have external hardware, such as mounting equipment, connection busses, and lifting lugs. These transformers are subject to leaking over time, resulting from damage to the transformer tank or from extended use. Such leakages can be environmentally damaging, inasmuch as the oil formulations within the transformers can often include hazardous chemicals (e.g., PCBs). In any event, it is necessary to safely transport failed transformers for disposal or repair, in accordance with governmental regulations. In like manner, other types of equipment, and especially electrical utility equipment, require safe and effective containment and shipping enclosures.

A number of different transformer containment devices have been provided in the past. For example, Andax Industries LLC has commercialized Xtra HD Pole-Mount Transformer Sac' containment bags, which have large, puncture-proof transformer bags with opposed perforated sections which can be opened to allow access to transformer lifting lugs. However, these bags do not provide any closures for these openings, and accordingly moisture or contaminants can enter the bags.

U.S. Pat. No. 8,777,001 describes another type of transformer containment bag which includes a bag with an internal liner and external lifting hoops. These kinds of bags are deficient, and indeed do not meet relevant regulatory standards, because the lifting lugs of the transformers cannot be accessed, thus requiring that the transformers be elevated and moved using only the bag components, which places considerable stress on the overall assemblies.

SUMMARY OF THE INVENTION

The present invention overcomes the problems outlined above and provides equipment containment and shipping bag assemblies which allow lifting and handling of equipment having lifting lugs via strategically located lug-access bag openings, while also preventing contamination of the assemblies and the equipment therein through the lug openings. As used herein, "lifting lugs" or "lugs" refers to any type of integrated lifting point(s) associated with the equipment to allow safe lifting and transport thereof. Such bag assemblies generally comprise a primary bag including upwardly extending sidewall structure having an upper margin, and a bottom wall secured to the sidewall structure to present an equipment-receiving container, with the sidewall structure having at least one pair of opposed access openings oriented to permit passage of the equipment lifting lugs therethrough; preferably, upper and lower opening pairs are provided to afford improved flexibility of use of the equipment containers. The assemblies also include a flexible tubular sleeve secured to the primary bag and movable between a ready position surrounding the primary bag sidewall structure, and a deployed position extending upwardly above the upper margin of the primary bag. Structure is provided for closing the opposed access openings, which may be respective parts of the tubular sleeve.

The sleeve may be secured to the primary bag at points below or above the opposed openings, and in both cases the second sleeve portion is integral with and is in effect a continuation of the first lower sleeve portion. The primary bag sidewall structure is preferably formed of a flexible, puncture-resistant synthetic resin material, and has a height greater than the height of the equipment. In order to provide a more rugged construction, the bottom wall of the primary bag has a thickness greater than that of the sidewall structure. The bag and sleeve may be substantially circular in cross-section, or any other shape required to accommodate different equipment designs.

The invention also provides a method of handling equipment, which comprises first placing the equipment within a primary bag of a bag assembly, the primary bag including upwardly extending sidewall structure having an upper margin, a bottom wall secured to the sidewall structure, and at least one pair of opposed openings through the sidewall structure. The assembly further has a flexible tubular sleeve secured to the primary bag and located in surrounding relationship about the sidewall structure; as used herein, "tubular" is intended to refer to any appropriate cross-sectional shape, such as circular, oval, or quadrate, for example. Next, the equipment and/or bag assembly are manipulated so that the lifting lugs protrude through selected access openings, allowing safe lifting of the equipment using these lugs. Once the equipment is safely positioned, the sleeve is shifted from its ready position to its deployed position, with structure covering the access openings of the primary bag.

Thus, a bag assembly for equipment having opposed lifting lugs generally comprises a primary bag including upwardly extending sidewall structure having an upper margin, and a bottom wall secured to the sidewall structure to present an equipment-receiving container. Sidewall structure has at least one pair of opposed openings oriented to permit passage of said lifting lugs therethrough; preferably, upper and lower pairs of such openings are provided to alternately permit passage of the lifting lugs therethrough. A flexible tubular sleeve is secured to the primary bag, and between the upper and lower opening pairs where such are provided. The sleeve is movable between a ready position surrounding the sidewall structure, and a deployed position extending upwardly beyond the upper margin. The bag assembly further has structure for selectively closing the provided opening pairs, which may be respective parts of the sleeve.

The sleeve is normally secured to the sidewall structure along a seam line and, where upper and lower access opening pairs are provided, the seam line is typically between such upper and lower opening pairs. Thus, when the sleeve is deployed, a portion above the seam line covers the upper pair of openings, whereas a portion below the seam line simultaneously covers the lower opening pair.

BRIEF DESCRIPTION OF THE DRAWINGS

While the drawings do not necessarily provide exact dimensions or tolerances for the illustrated components or structures, FIGS. 1-14 are to scale with respect to the relationships between the components of the structures illustrated therein.

DETAILED DESCRIPTION OF THE PREFERRED EMBODIMENTS

Figures 10, 11, 12, 13:
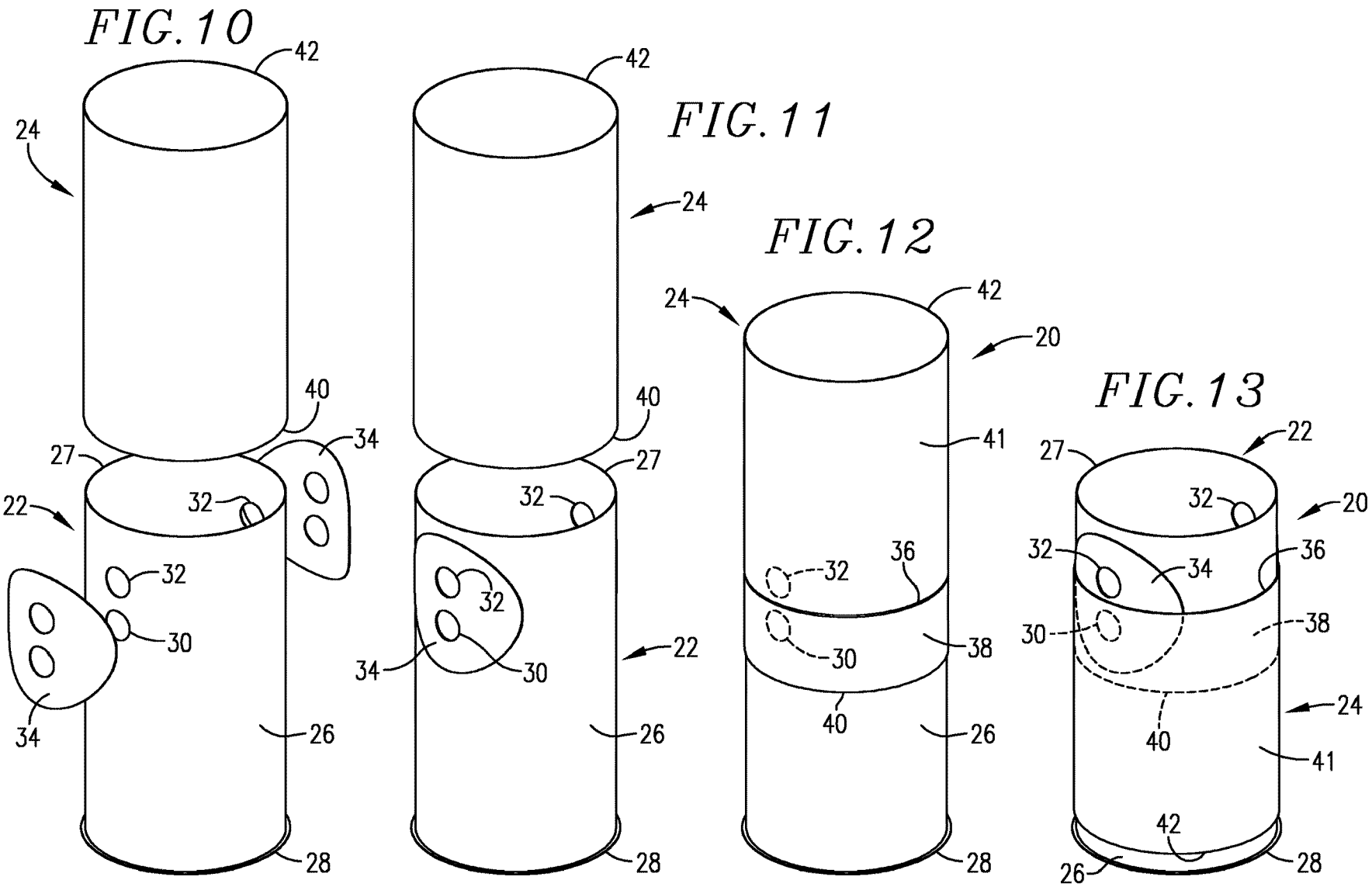
FIG. 10 is an exploded perspective view of the bag assembly in accordance with the invention, illustrating the respective components of the bag assembly.
FIG. 11 is an exploded perspective view similar to that of FIG. 10, but illustrating the reinforcement panels of the primary bag attached to the exterior surface of the sidewall structure thereof.
FIG. 12 is a perspective view of the bag assembly, shown with the sleeve secured to the sidewall structure of the primary bag along a seam line between the upper and lower pairs of access openings of the primary bag, and with the sleeve in its upwardly raised, deployed position.
FIG. 13 is a perspective view similar to that of FIG. 12, but illustrating the sleeve in its lowered, ready position.

An equipment or transformer bag assembly 20 is illustrated in the drawings, and generally includes an upright, open-top primary bag 22 and a flexible tubular sleeve 24, which is separate from the bag 20, but operably secured to the latter. As depicted, the primary bag 22 includes upstanding sidewall structure 26 with an upper margin 27 and a bottom wall 28 secured thereto. The sidewall structure 26 is provided with a first lower pair of opposed openings 30, and a second upper pair of opposed openings 32, which are important for purposes to be described. To this end, the sidewall structure 28 has a pair of apertured reinforcing panels 34 secured to the outer face thereof, as best illustrated in FIGS. 10-11.

The sleeve 24 is of unitary tubular construction and is attached to the outer surface of sidewall structure 26 between the upper and lower pairs of openings 30, 32. This attachment is preferably along a circumferential fusion or seam line 36; such bonding may be effected by heat welding or chemical bonding, for example. As best seen in FIG. 12, the seam line 36 is intermediate the opposed ends of the sleeve 24, so that a depending flap section 38 is defined between the seam line 36 and the adjacent edge 40 of the sleeve 24. A significantly longer bag closure section 41 extends from seam line 36 to the opposite edge 42 of the sleeve 24.

The primary bag 22 is designed to hold equipment such as an electrical transformer 44 for handling and shipping thereof. The transformer 44 is itself entirely conventional and includes an upright tank 46 containing oil and electrical components. The transformer 44 would also typically include other external hardware such as mounting lugs and connection bushings (not shown). A pair of oppositely outwardly extending lifting lugs 48 are secured to the tank 46 and are designed for safe lifting and handling of the transformer.

The provision of the upper and lower pairs of opposed openings 30 and 32 and the design of sleeve 24 afford a great deal of flexibility in use of bag assembly 20. At the same time, equipment within the assembly can be readily protected against the elements, both in transport and storage.

Figure 2:
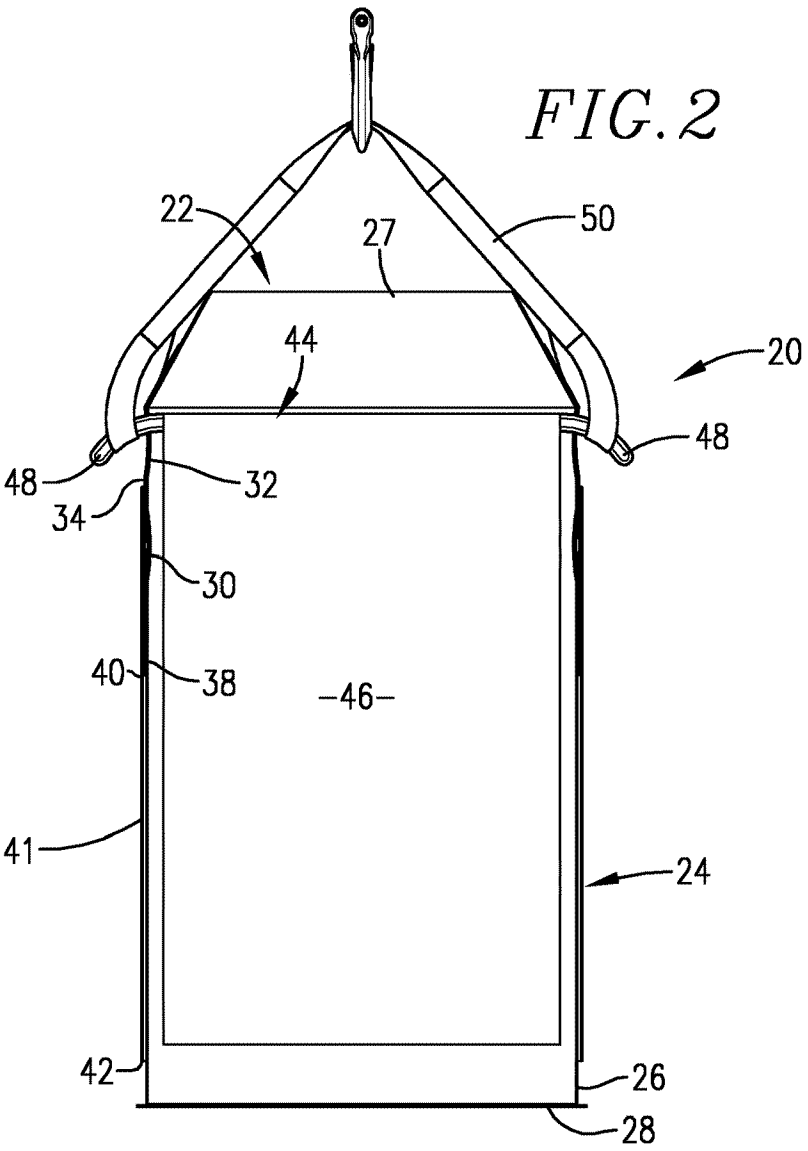
FIG. 2 is a fragmentary vertical sectional view of the bag assembly illustrated in FIG. 1.

For example, in one use of bag assembly 20, the transformer 44 is first detached from its normal mounting (e.g., a utility pole) and suspended via the lugs 48 using a lift strap 50 or the like; the primary bag 22 is then preliminarily placed about the suspended transformer 44. It will be observed (FIG. 2) that the length of the sidewall structure 26 is such that there is a space between the base of the transformer and bottom wall 28. As such, the bag assembly 20 is not placed under any load during lifting of the transformer 44; rather, the bag assembly serves merely as a containment device.

Figure 1:
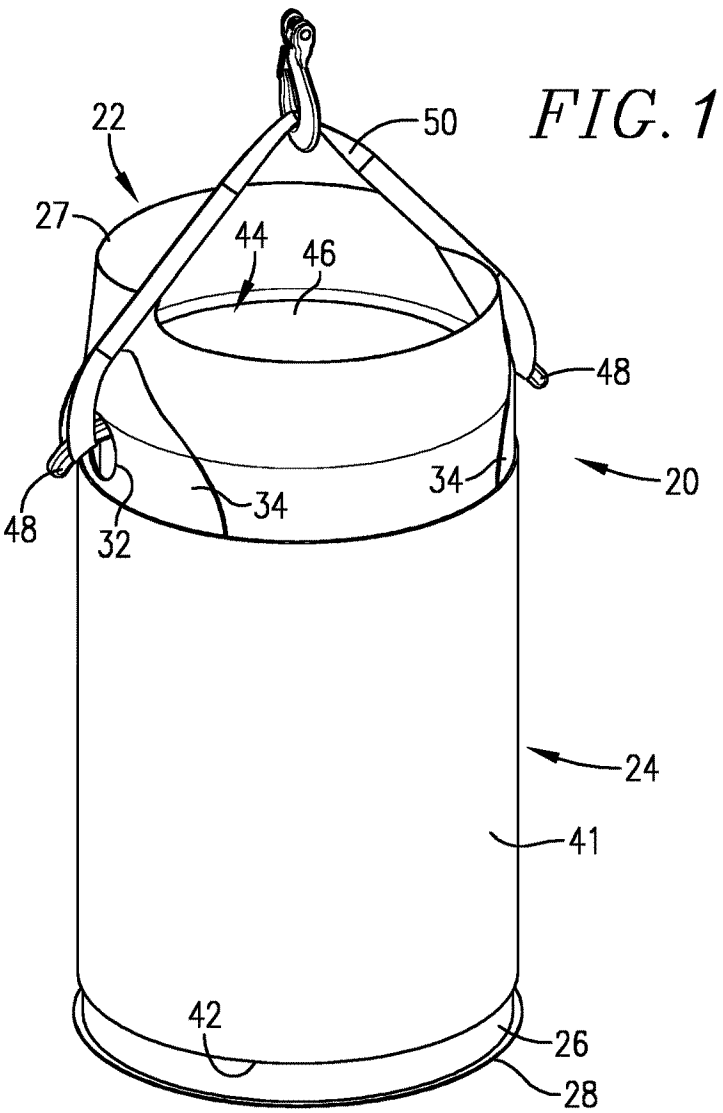
FIG. 1 is a perspective view of an equipment bag assembly in accordance with the invention, illustrated with a primary bag and a separate tubular sleeve, with the sleeve in its lowered, ready position with the lugs of a transformer within the primary bag extending through bag openings, and with a lift strap secured to the lugs.
Figure 4:
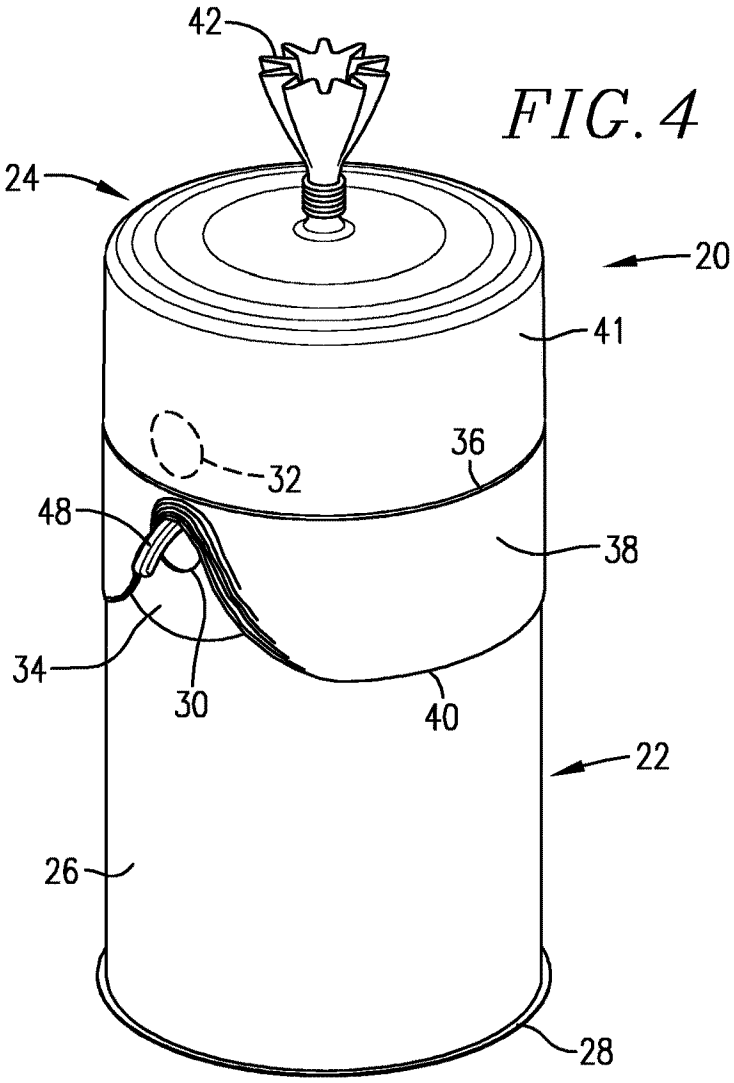
FIG. 4 is a view similar to that of FIG. 3, but illustrating a lifting lug protruding through the lower access opening of the primary bag.
Figure 3:
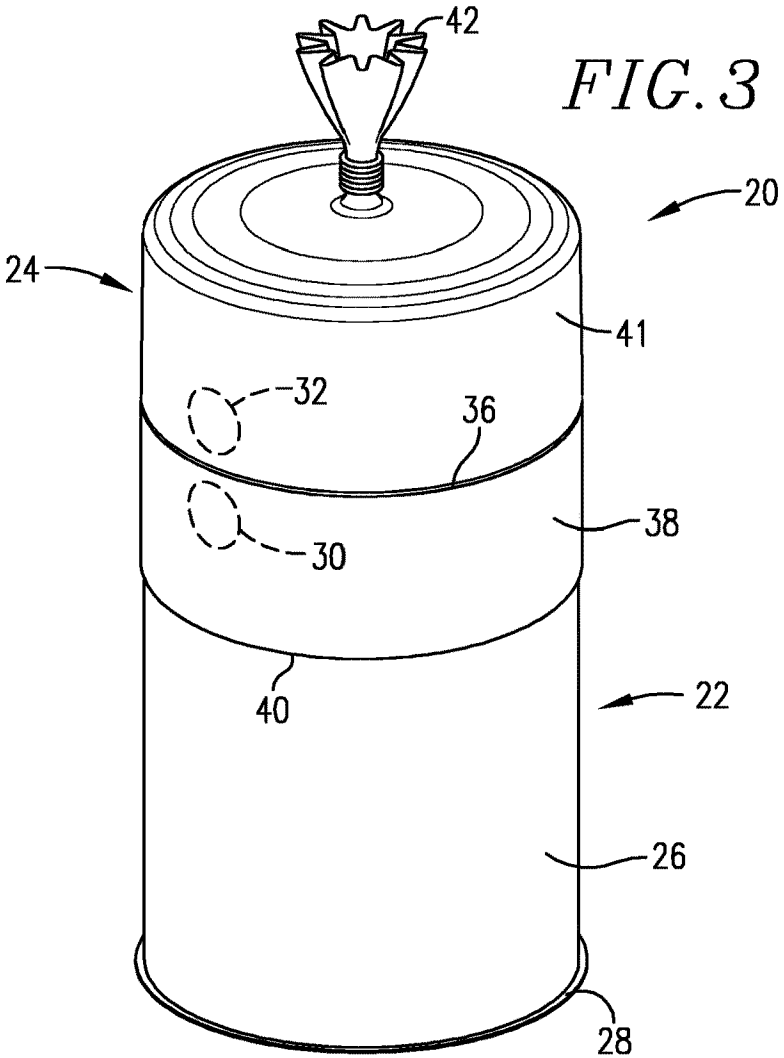
FIG. 3 is a perspective view of the equipment bag assembly of FIGS. 1-2, illustrated with the access openings of the primary bag covered and with the upper end of the tubular sleeve gathered and closed.
Figure 5:
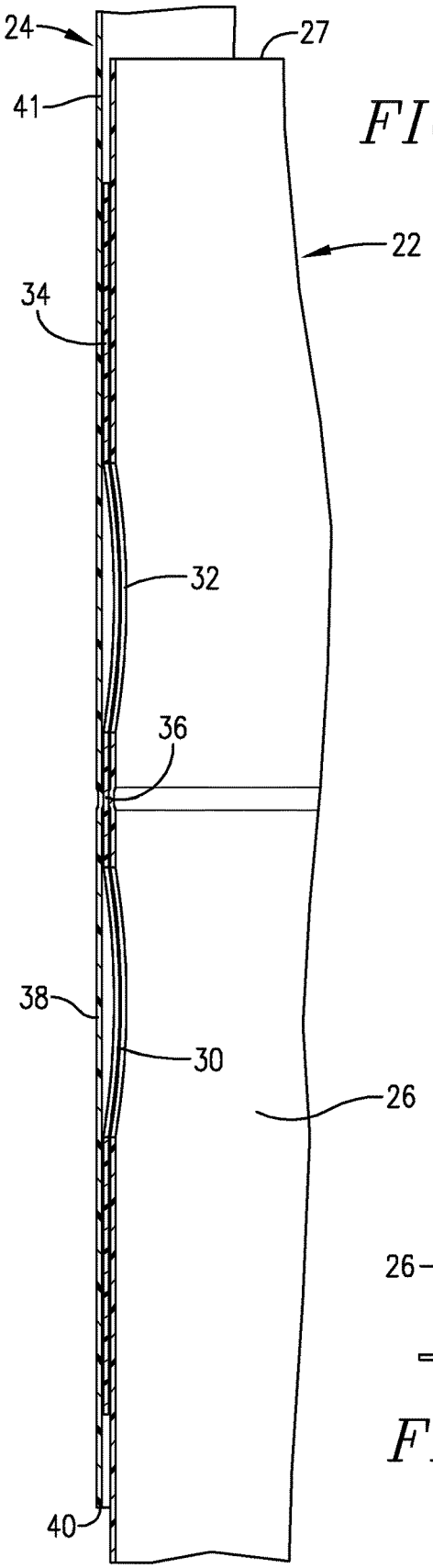
FIG. 5 is a fragmentary vertical sectional view illustrating the interconnection of the primary bag and sleeve of the assembly, with the sleeve in its extended position.
Figure 6:
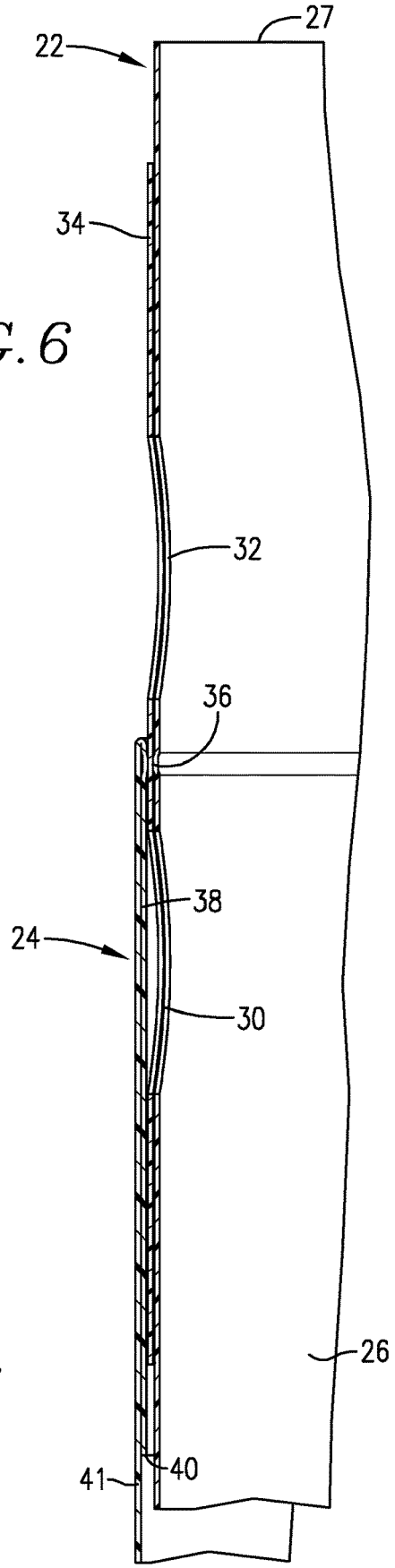
FIG. 6 is a fragmentary vertical sectional view similar to that of FIG. 5, but illustrating the sleeve in its lowered, ready position.
Figure 8:
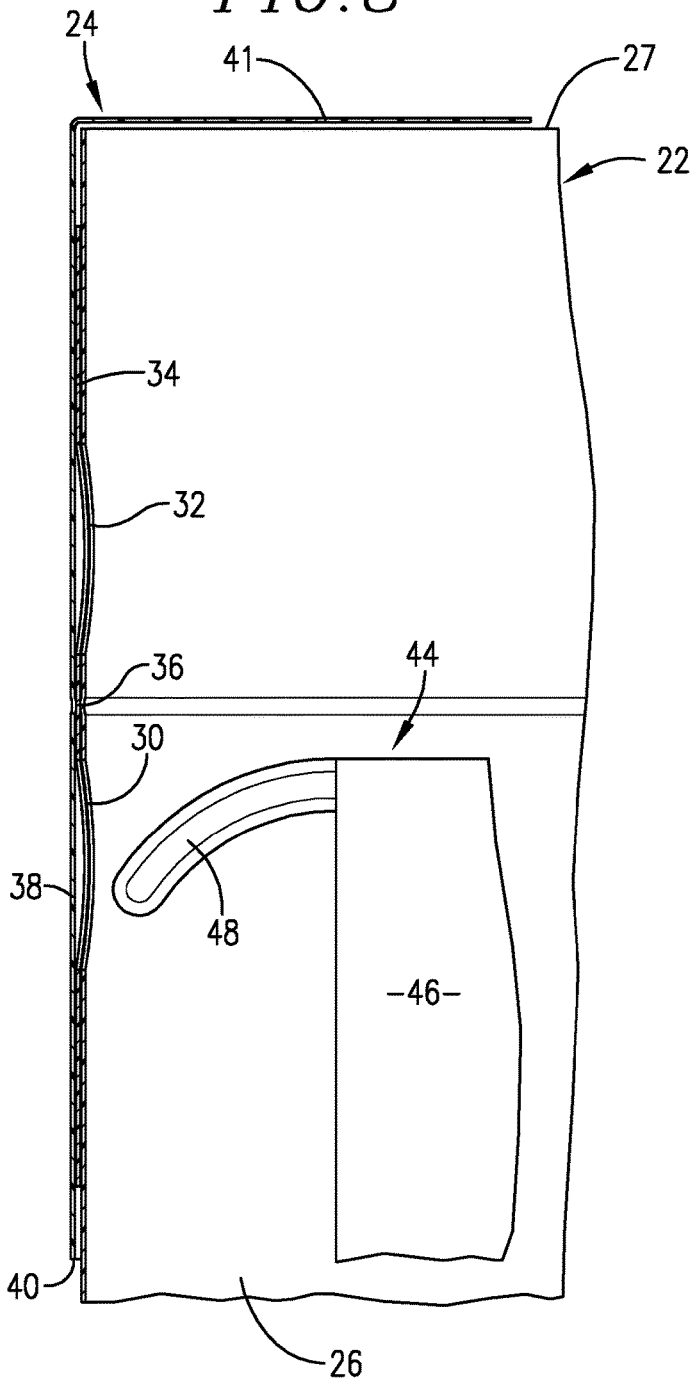
FIG. 8 is an enlarged, partial vertical sectional view of the assembly of FIG. 1, illustrating a transformer wholly within the confines of the primary bag and with the sleeve in its upwardly raised, deployed position.
Figure 9:
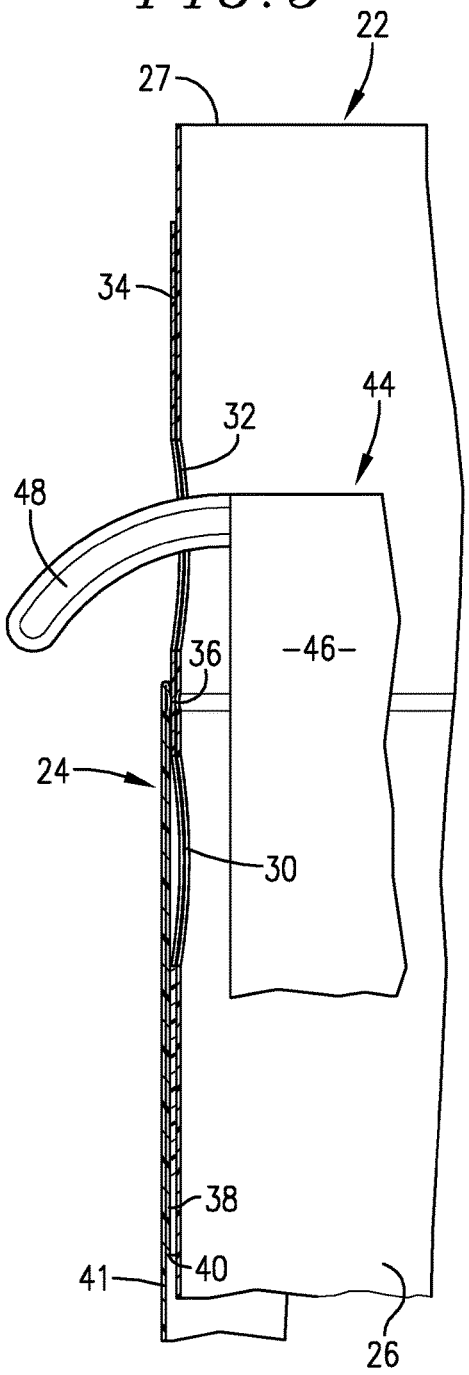
FIG. 9 is an enlarged, partial vertical sectional view of the assembly of FIG. 1, with the lifting lug of a transformer protruding through one of the primary bag openings.

The transformer and partially applied assembly 20 are then placed on a stable surface, such as a truck bed, and the lift strap 50 is removed. Then, the bag 22 is further manipulated so that the lugs 48 protrude through the openings 30 or 32, and the sleeve 24 is in its ready position, so that the transformer and assembly 20 can be further moved as desired using strap 50. (In FIGS. 1-2, the lugs 48 protrude through the openings 32, whereas in FIG. 4, the lugs 48 protrude through the lower openings 30). Once the transformer is in a secure transport or storage position, the sleeve 24, and particularly the closure section 41 thereof, is elevated above the open end of the bag 22 and closed. If desired, the bag 22 can be manipulated so that the lugs 48 are entirely within the confines of bag 22 (FIG. 8). Closure of section 41 may be effected by any conventional means, such as by gathering the section 41 and tying it off (FIGS. 3-4). It will be seen that the flap section 38 covers the openings 30, whereas a second portion of the sleeve 24 above seam line 36 covers the openings 32. In this condition, the transformer 44 may be safely transported without fear of water or other contaminants entering the bag assembly 20.

Further, even when the bag assembly 20 is closed, to protect the transformer 44, it can be easily moved by access to the lifting lugs 48 through the lower pair of openings 30. The flap section 38 need only be lifted and the bag manipulated to expose the lugs for lifting purposes. At the same time, after such movement, the flap section 38 will again serve to cover the opening pair 30.

Figure 7:
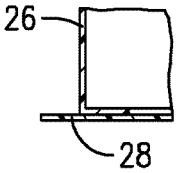
FIG. 7 is a partial sectional view illustrating the attachment of the bottom wall of the bag assembly, with the bottom wall secured to the upstanding sidewall structure of the primary bag.

Advantageously, so as to provide a rugged primary bag 22, bottom wall 28 should be formed of a thicker material, as compared with sidewall structure 26 (FIG. 7). Again, the bottom wall 28 may be affixed by heat welding or other secure bonding. Additionally, the upper surface of the bottom wall may be provided with an absorbent material (not shown) to absorb oil or other liquids leaking from transformer tank 46.

Figure 14:
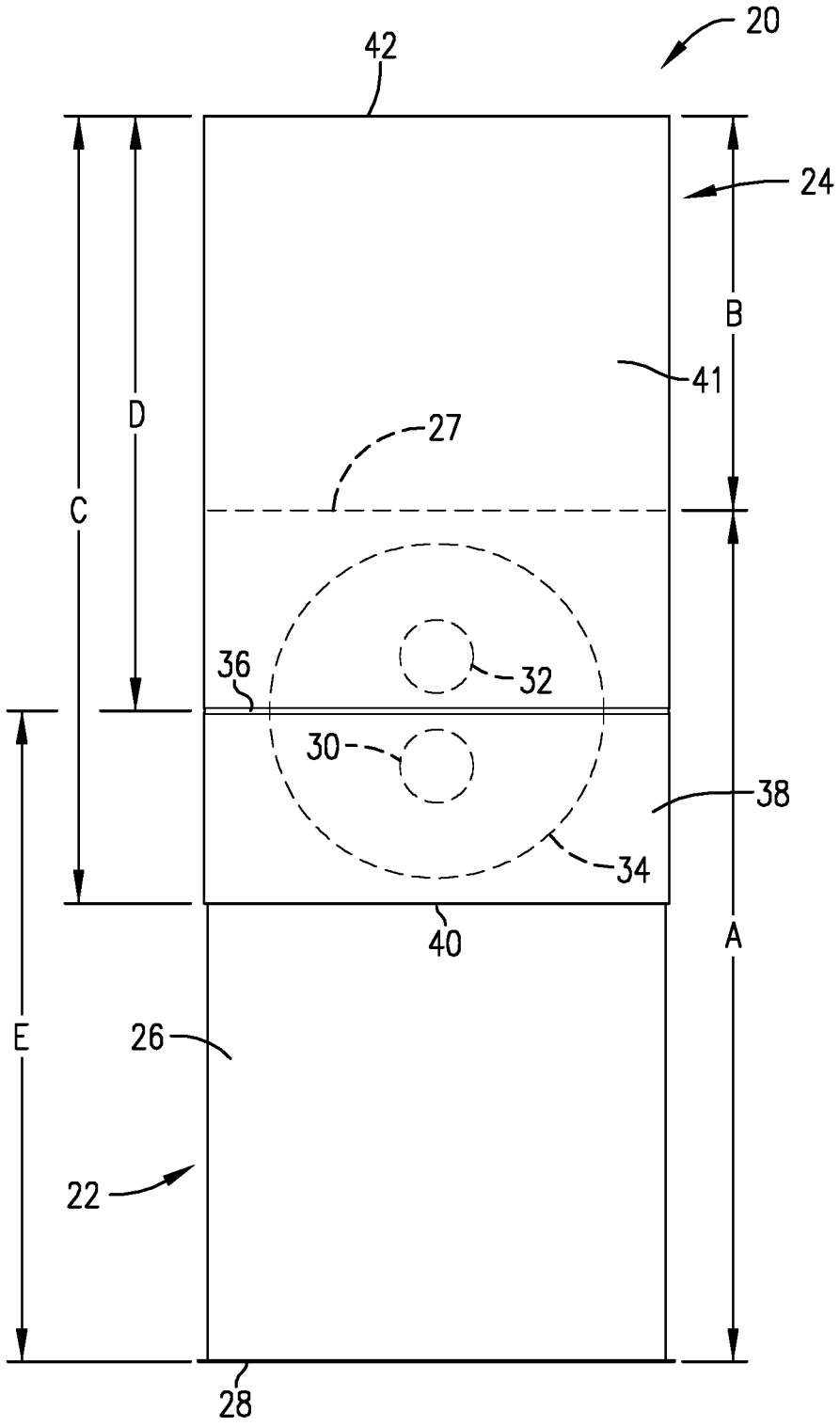
FIG. 14 is an elevational view similar to that of FIG. 12, with certain dimensional relationships between the primary bag and sleeve depicted on the figure.

In order to provide the most effective bag assembly 20, certain design considerations should be taken into account. Referring to FIG. 14, it will be seen that the height of primary bag 22 between bottom wall 28 and upper margin 27 is referred to as dimension A; the height of sleeve 24 extending above upper margin 27 to upper edge 42 is referred to as dimension B; the height of sleeve 24 between edges 40 and 42 is referred to as dimension C; the height of sleeve 24 between seam line 36 and upper edge 42 is referred to as dimension D; and the height of sidewall structure 26 between bottom wall 28 and seam line 36 is referred to as dimension E.

In preferred practice, dimension C should be less than dimension A, e.g., dimension C should be at least about at least about 80% (more preferably at least about 90%) of dimension A. Additionally, dimension D should be less than dimension A, e.g., dimension D should be at least about 50% (more preferably at least about 35%) of dimension A. Finally, dimension D should be less than dimension E, e.g., dimension D should be at least about 75% (more preferably at least about 85%) of dimension E.

In the depicted embodiment, the sidewall structure 26, bottom wall 28, and sleeve 24 may be formed of any desired flexible material. Particularly preferred are coextruded and reinforced synthetic resin materials, such as polyethylenes and polyurethanes, having a thickness of from about 5-20 mils. Additionally, while the primary bag 22 and the sleeve 24 are illustrated as being substantially circular in cross-section, it will be appreciated that other shapes may be employed, depending upon the types of equipment to be handled. Furthermore, while the lugs 48 could be moved entirely within the confines of the primary bag 22, such is not necessary; rather, the bag assemblies could be configured so that the lugs 48 remain at least partially outside the primary bag 22, and, in these instances, the flap portion 38 of the sleeve 24 would be sized to accommodate these protruding lugs 48. Finally, while the sleeve 24 is illustrated as being structurally separate but secured to the primary bag 22, the latter could be manufactured to include integral sleeve.

The openings 30, 32 formed by registration of the apertured reinforcing panels 34 and the openings formed in primary bag sidewall structure 26 are shown as fully cut through-openings (see, e.g., FIGS. 10-11). However, for ease of manufacture, these openings need not be fully cut, e.g., the material of the panels 34 and sidewall structure 26 may be cut to define a plurality of movable flaps, such as four quadrant flaps. Such embodiments permit full operability, inasmuch as the lugs 48 can push through the flaps without difficulty. Accordingly, all such design expedients are deemed to be "openings" in the context of the invention.

We claim:

1. A bag assembly for equipment having a pair of opposed lifting lugs, said bag assembly comprising:

a primary bag including upwardly extending sidewall structure having an upper margin, and a bottom wall secured to the sidewall structure to present an equipment-receiving container, said sidewall structure having an upper pair of opposed openings oriented to permit passage of said lifting lugs therethrough, and a lower pair of opposed openings oriented to alternately permit passage of said lifting lugs therethrough; and a flexible tubular sleeve secured to said primary bag between said upper and lower opening pairs, said sleeve movable between a ready position surrounding said sidewall structure, and a deployed position extending upwardly beyond said upper margin.

2. The bag assembly of claim 1, including structure for selectively closing said upper and/or lower pairs of openings.

3. The bag assembly of claim 2, said sleeve defining said structure.

4. The bag assembly of claim 3, said sleeve secured to said sidewall structure along a seam line, a first part of said sleeve above said seam line oriented to cover said upper pair of opposed openings when said sleeve is in the deployed position thereof, said structure comprising the first part of the sleeve.

5. The bag assembly of claim 4, said sleeve secured to said sidewall structure along the seam line, a second part of said sleeve below said seam line oriented to cover said lower pair of opposed openings when said sleeve is in the ready position thereof, said structure further comprising the second part of the sleeve.

6. The bag assembly of claim 5, said first and second sleeve parts operable to simultaneously cover said upper and lower pairs of opposed openings when said sleeve is in the deployed position thereof.

7. The bag assembly of claim 1, said primary bag configured to permit said lifting lugs to be positioned within the confines of said primary bag.

8. The bag assembly of claim 1, said sidewall structure of a height greater than a height of said equipment.

9. The bag assembly of claim 1, said primary bag and sleeve formed of reinforced synthetic resin material.

10. The bag assembly of claim 1, said bottom wall having a greater thickness than a thickness of said sidewall structure.

11. The bag assembly of claim 1, said primary bag having an open top.

12. A bag assembly for equipment having a pair of opposed lifting lugs, said bag assembly comprising:

a primary bag including upwardly extending sidewall structure having an upper margin, and a bottom wall secured to the sidewall structure to present an equipment-receiving container, said sidewall structure having a pair of opposed openings oriented to permit passage of said lifting lugs therethrough; and a flexible tubular sleeve secured to said primary bag along a seam line below said pair of opposed openings, said sleeve movable between a ready position surrounding said sidewall structure, and a deployed position extending upwardly beyond said upper margin, said sleeve presenting an upper margin, a height of said sleeve between said sleeve upper margin and said seam line being at least about 75% of a height of said primary bag between said bottom wall and said primary bag upper margin.

13. The bag assembly of claim 12, said pair of opposed openings being an upper pair of opposed openings, said sidewall structure further having a lower pair of opposed openings, said sleeve secured to said primary bag between the upper and lower pairs of opposed openings.

14. The bag assembly of claim 13, including structure for selectively closing said upper and lower pairs of openings.

15. The bag assembly of claim 14, said sleeve defining said structure.

16. The bag assembly of claim 15, said sleeve secured to said sidewall structure along the seam line, a first part of said sleeve above said seam line oriented to cover said upper pair of opposed openings when said sleeve is in the deployed position thereof, said structure comprising the first part of the sleeve.

17. The bag assembly of claim 16, said sleeve secured to said sidewall structure along the seam line, a second part of said sleeve below said seam line oriented to cover said lower pair of opposed openings when said sleeve is in the ready position thereof, said structure further comprising the second part of the sleeve.

18. The bag assembly of claim 17, said first and second sleeve parts operable to simultaneously cover said upper and lower pairs of opposed openings when said sleeve is in the deployed position thereof.

19. The bag assembly of claim 12, said primary bag configured to permit said lifting lugs to be positioned within the confines of said primary bag.

20. The bag assembly of claim 12, said sidewall structure of a height greater than a height of said equipment.

21. The bag assembly of claim 12, said primary bag and sleeve formed of reinforced synthetic resin material.

22. The bag assembly of claim 12, said bottom wall having a greater thickness than a thickness of said sidewall structure.

23. The bag assembly of claim 12, said primary bag having an open top.

24. A method of handling equipment having a pair of opposed lifting lugs, said method comprising the steps of:

placing said equipment within a primary bag of a bag assembly, said primary bag including upwardly extending sidewall structure having an upper margin, a bottom wall secured to said sidewall structure, a pair of opposed openings through the sidewall structure, said assembly further including a flexible tubular sleeve secured to said primary bag and located in surrounding relationship about the sidewall structure;

positioning said equipment and/or primary bag so that said lifting lugs protrude through said opposed openings;

lifting said equipment and primary bag using said protruding lifting lugs;

shifting said sleeve so that a portion of the sleeve extends above the upper margin of said primary bag; and using structure to cover said pair of opposed openings.

25. The method of claim 24, said step of using structure to cover said pair of openings including the step of using a portion of said sleeve to cover said pair of opposed openings.

26. The method of claim 24, said primary bag including an upper pair of opposed openings through said sidewall structure, and a lower pair of opposed openings through said sidewall structure, said pair of opposed openings comprising either of said upper or lower pairs of opposed openings such that said positioning step comprises the step of alternately positioning said equipment and/or primary bag so that said lifting lugs protrude through either said upper or lower pair of opposed openings.

27. The method of claim 26, including the step of further using said structure to cover both said upper and lower pairs of opposed openings.

28. The method of claim 27, said sleeve defining said structure for covering said both upper and lower pairs of opposed openings.

29. The method of claim 27, said sleeve secured to said primary bag along a seam line between said upper and lower pairs of opposed openings, said sleeve movable between a ready position surrounding said sidewall structure, and a deployed position extending upwardly beyond said primary bag upper margin, said sleeve presenting an upper margin, a height of said sleeve between said sleeve upper margin and said seam line being at least about 75% of a height of said primary bag between said bottom wall and said primary bag upper margin, said sleeve defining said structure for covering said both upper and lower pairs of opposed openings.

30. The method of claim 24, said equipment comprising a transformer.

31. A method of handling equipment having a pair of opposed lifting lugs, said equipment housed within a bag assembly including a primary bag having upwardly extending sidewall structure with an upper margin, a bottom wall secured to said sidewall structure, and a flexible tubular sleeve secured to said primary bag, said equipment housed within said primary bag with said sleeve extending upwardly in covering relationship to said equipment, said sidewall structure having a pair of opposed openings closed by shiftable closure structure defined by said sleeve, said method comprising the steps of:

positioning said equipment and/or primary bag so that said lifting lugs protrude through said opposed openings; and lifting said equipment and primary bag using said protruding lifting lugs.

32. The method of claim 31, including the steps of, after said lifting step, using said closure structure to re-cover said opposed openings.

* * * * *